US006983622B2

(12) United States Patent
De Bernardi et al.

(10) Patent No.: US 6,983,622 B2
(45) Date of Patent: Jan. 10, 2006

(54) GAS DISTRIBUTION DEVICE

(75) Inventors: Jean De Bernardi, Lyons (FR); Mickaël Euthine, Rillieux la Pape (FR)

(73) Assignees: Danfoss Commercial Compressors, Reyrieux (FR); Carrier Corporation, Farmington, CT (US)

( * ) Notice: Subject to any disclaimer, the term of this patent is extended or adjusted under 35 U.S.C. 154(b) by 42 days.

(21) Appl. No.: 10/827,319

(22) Filed: Apr. 20, 2004

(65) Prior Publication Data

US 2005/0229627 A1 Oct. 20, 2005

(51) Int. Cl.
*F25B 43/02* (2006.01)

(52) U.S. Cl. ..... 62/468; 184/6.16

(58) Field of Classification Search ..... 62/192, 62/193, 468, 469, 510; 184/6.16; 418/83
See application file for complete search history.

(56) References Cited

U.S. PATENT DOCUMENTS 3,766,745 A * 10/1973 Quick ..... 62/196.2
4,179,248 A * 12/1979 Shaw ..... 417/427
4,484,449 A * 11/1984 Muench ..... 62/79
4,589,263 A * 5/1986 DiCarlo et al. ..... 62/193
4,741,674 A * 5/1988 Tischer ..... 417/295
5,243,832 A * 9/1993 Van Steenburgh, Jr. ..... 62/292
6,131,401 A * 10/2000 Ueno et al. ..... 62/175
6,185,946 B1 * 2/2001 Hartman ..... 62/175
6,502,409 B1 * 1/2003 Gatling et al. ..... 62/80
6,604,371 B2 * 8/2003 Ueno ..... 62/193
6,698,217 B2 * 3/2004 Tanimoto et al. ..... 62/175
6,722,156 B2 * 4/2004 Tanimoto et al. ..... 62/510
6,755,029 B2 * 6/2004 Bertrand et al. ..... 62/84

FOREIGN PATENT DOCUMENTS

JP 2001-329958 A * 11/2001
JP 2002-147876 A * 5/2002

* cited by examiner

*Primary Examiner*—Mohammad M. Ali
(74) *Attorney, Agent, or Firm*—Oliff & Berridge

(57) ABSTRACT

Device for distributing suction gas for a parallel compressor installation, said installation having at least two refrigeration compressors, at least one oil level equalization tube providing a communication between the oil pans provided in the bodies of the compressors, at least one suction gas distribution device comprising an essentially straight distribution tube, and branch tubes. The branch tubes have at least one portion forming an angle of between 55° and 65° with the axis of the distribution tube. The present invention uses a special geometry for equalizing the pressures in the oil pans of each compressor and thus using simple equalization channels.

12 Claims, 2 Drawing Sheets

GAS DISTRIBUTION DEVICE

BACKGROUND OF THE INVENTION

1. Field of Invention

The present invention relates to a suction gas distribution device for parallel compressor installations.

At least four constraints must be borne in mind when several refrigeration compressors are operated in parallel:

apportioning the oil levels in each compressor;

reducing pressure losses at the suction end in order to maximize the performance factor;

maintaining a minimum flowrate in the pipe to create shear forces that push the oil covering the walls to the compressors; and total piping cost.

2. Description of Related Art

The present state of the art offers several existing solutions.

Compressors are often arranged in parallel in refrigeration applications. Oil apportioning systems in this case are complex and expensive, based on combining common oil collectors, devices for measuring individual levels, and solenoid distribution valves. These systems are prohibitively expensive in air-conditioning applications.

Another, less expensive, method consists of forcing the oil return to a compressor and then creating pressure drops at the inlet of each to the compressor to force a balanced oil distribution. The disadvantage of this system resides in the pressure losses generated, which have a direct impact on the energy performance of the cooling system. Moreover, producing several welds to create local pressure losses impacts cost as well as reliability, as the welds increase the risk of leakage.

The following prior art documents describe several solutions for apportioning the oil based on the suction gas distribution mechanism.

U.S. Pat. No. 3,386,262 describes a Y connector and separate flow restriction in a branch line. U.S. Pat. No. 4,729,228 describes a gas flow separator. These two solutions result in an unequal supply of gas and oil to the compressors, with the desired pressure difference equalizing the oil levels through a simple pipe.

U.S. Pat. No. 4,411,141 also shows an oil separation device inside the suction line, and a nonreturn valve in the oil equalization line.

Two other documents, U.S. Pat. No. 4,741,674 and U.S. Pat. No. 4,750,337 relate to parallel compressor arrangements where the suction pressure in the compressor body is kept equal. To achieve this result, U.S. Pat. No. 4,741,674 describes a separate pressure equalization line, different from the oil level equalization line. Valves responding to pressure drops for each compressor are present in the suction distributor to eliminate suction at the inoperative compressors. U.S. Pat. No. 4,750,337 describes a valve arrangement in the suction distributor that ensures pressure equalization in the compressor body.

U.S. Pat. No. 4,551,989 describes a suction distributor arrangement using a T part with a distribution tube mounted below the suction orifices of the compressor bodies, with branch lines connecting the distribution tube to the compressor body and extending perpendicularly to the distribution tube. The dimensions of the branches are designed to allow a sufficient gas velocity for the oil return to the compressor bodies.

SUMMARY OF THE INVENTION

The present invention overcomes the disadvantages of the previous devices exhibiting overcomplexity or pressure losses in the oil suction or equalization lines by using a particular geometry to equalize the pressures in the oil pans of each compressor and thus use simple equalization lines.

The present invention according to one exemplary embodiment relates to a device for distributing suction gas for a parallel compressor installation, said installation including:

at least two refrigeration compressors, each having a body delimiting an inside space;

at least one oil level equalization tube providing a communication between the oil pans provided in the bodies of the compressors; and at least one suction gas distribution device comprising an essentially straight distribution tube as well as branch tubes providing communication between the distribution tube and the spaces inside the bodies of the compressors, and characterized in that the branch tubes have at least one portion forming an angle of between 55° and 65° with the axis of the distribution tube.

Specifying an angle of between 55° and 65° gives the pressure equalization characteristics desired.

The compressors may be of various kinds. They may be for example scroll compressors, piston compressors, rotary or screw compressors, or hermetic or semihermetic compressors.

The present invention according to one exemplary embodiment is also characterized in that the distribution tube has a straight portion upstream of the first branch, the length of said straight portion being equal to at least five times the outside diameter of the distribution tube. Advantageously, the length of the straight portion of the distribution tube upstream of the first branch is between five and seven times the outside diameter of the distribution tube. The presence of this straight portion leads to a homogenous velocity profile after the bend, if present, at the end of the distribution tube.

The present invention according to one exemplary embodiment is also characterized in that the branch tubes have a smaller outside diameter than the outside diameter of the distribution tube. Advantageously, the ratio between the outside diameter of the branch tubes and the outside diameter of the distribution tube is between 60 and 85%.

Advantageously, the outside diameter of the branch tubes is essentially equal to 1⅝ inches (one inch being equal to 2.540 cm), the outside diameter of the distribution tube being essentially equal to 2⅝ inches in the case that three or four compressors are arranged in parallel or essentially equal to 2⅛ inches in the case that two compressors are arranged in parallel. The various diameters used are chosen to maintain the minimum gas velocity and guarantee equal pressure levels between the compressors.

The present invention according to one exemplary embodiment is also characterized in that the distance between two branches of the distribution tube is at least five times the outside diameter of the distribution tube. The distance between the branches prevents perturbations in the velocity profile brought about by one branch from altering the gas behavior in the next branch.

The present invention according to one exemplary embodiment is also characterized in that the branch tubes have a bent portion downstream of the portion whose axis makes an angle of between 55° and 65° with the axis of the distribution tube, said bent portion having a bending angle of between 115 and 120° and a bending ratio essentially equal to 1.25 times the outside diameter of the branch tube. This bent portion contributes to equalization of the pressure between the compressors.

The present invention according to one exemplary embodiment is also characterized in that the portion forming an angle of between 55° and 65° with the axis of the distribution tube is adjacent to the distribution tube on at least one of the branch tubes.

The present invention according to one exemplary embodiment is also characterized in that the last branch tube has a straight portion positioned in the axis of the distribution tube and communicating therewith, upstream of the straight portion whose axis forms an angle of between 55° and 65° with the axis of the distribution tube. The desired effect of supplying a gas at an equal pressure for all the compressors is based on using branch portions inclined at an angle of between 55° and 65° relative to the distribution flow. Hence, the inclined portions must be adjacent to the distribution tube or connected to the straight portion of the end branch which is in the extension of the distribution tube.

The present invention according to one exemplary embodiment is also characterized in that the straight portion of the last branch tube positioned in the axis of the distribution tube and communicating therewith has a length equal to at least five times the outside diameter of the distribution tube. This straight portion prevents perturbations in the velocity profile brought about by the penultimate branch from altering the gas behavior in the last branch.

The present invention according to one exemplary embodiment is also characterized in that at least one of the branch tubes has a collar at its end joined to the distribution tube. The collar attachment prevents welds from projecting into the flow, causing pressure losses and reducing the reliability of the device.

The invention will be better understood with the aid of the following description, with reference to the attached schematic drawing showing several embodiments.

DETAILED DESCRIPTION OF PREFERRED EMBODIMENTS

Figure 1:
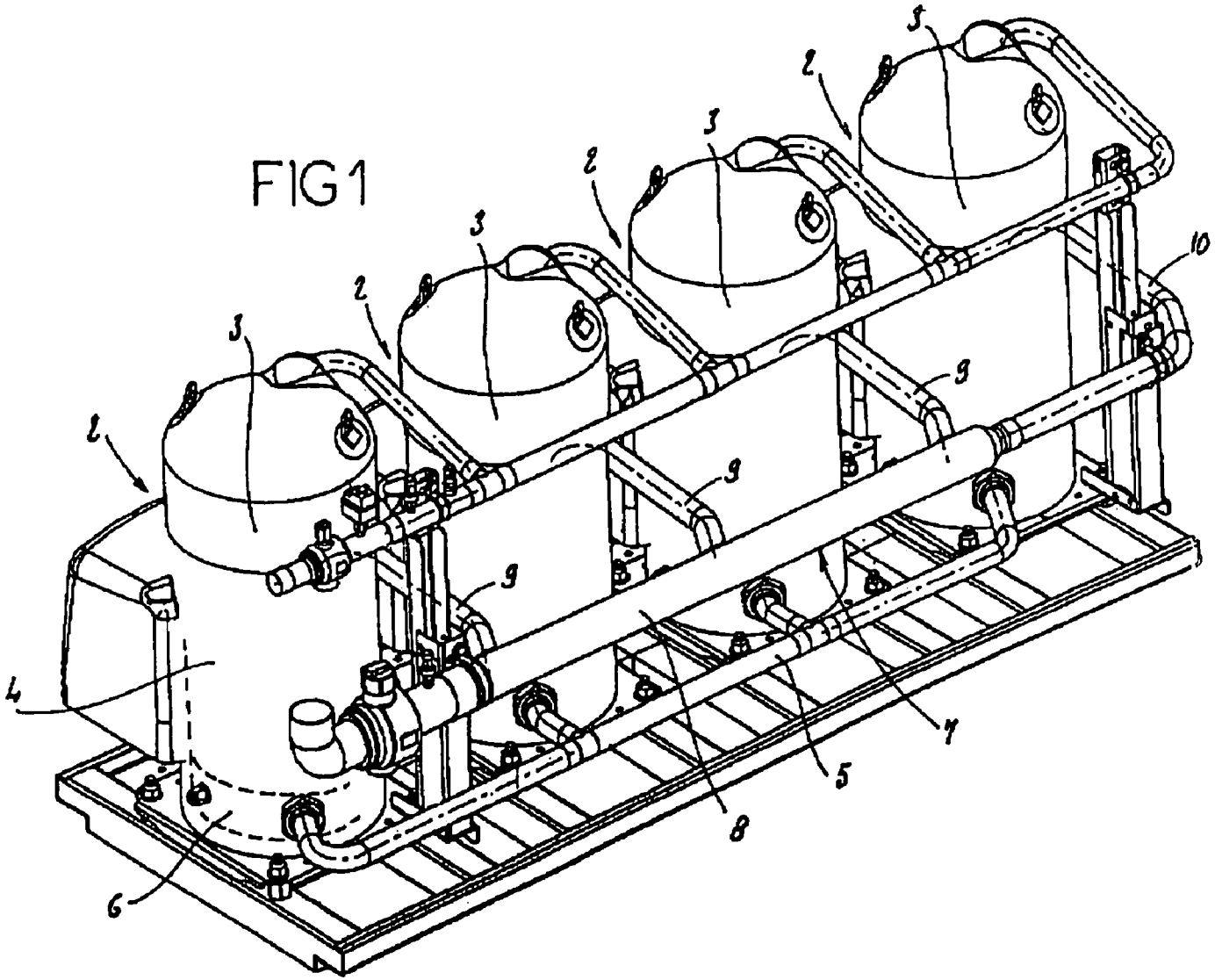
FIG. 1 is a general view of an arrangement of four compressors in parallel using the distribution device.

FIG. 1 describes an arrangement of compressors in parallel, including:

- four refrigeration compressors, each having a body 3 delimiting an inside space 4;
- an oil level equalization tube 5 providing communication between the oil pans 6 provided in the body 3 of compressors 2; and
- a suction gas distribution device 7 comprising a substantially straight distribution tube 8 as well as branch tubes 9, 10 providing communication between the distribution tube 8 and the inside spaces 4 of the bodies of compressors 2.

Figures 2, 3, 4:
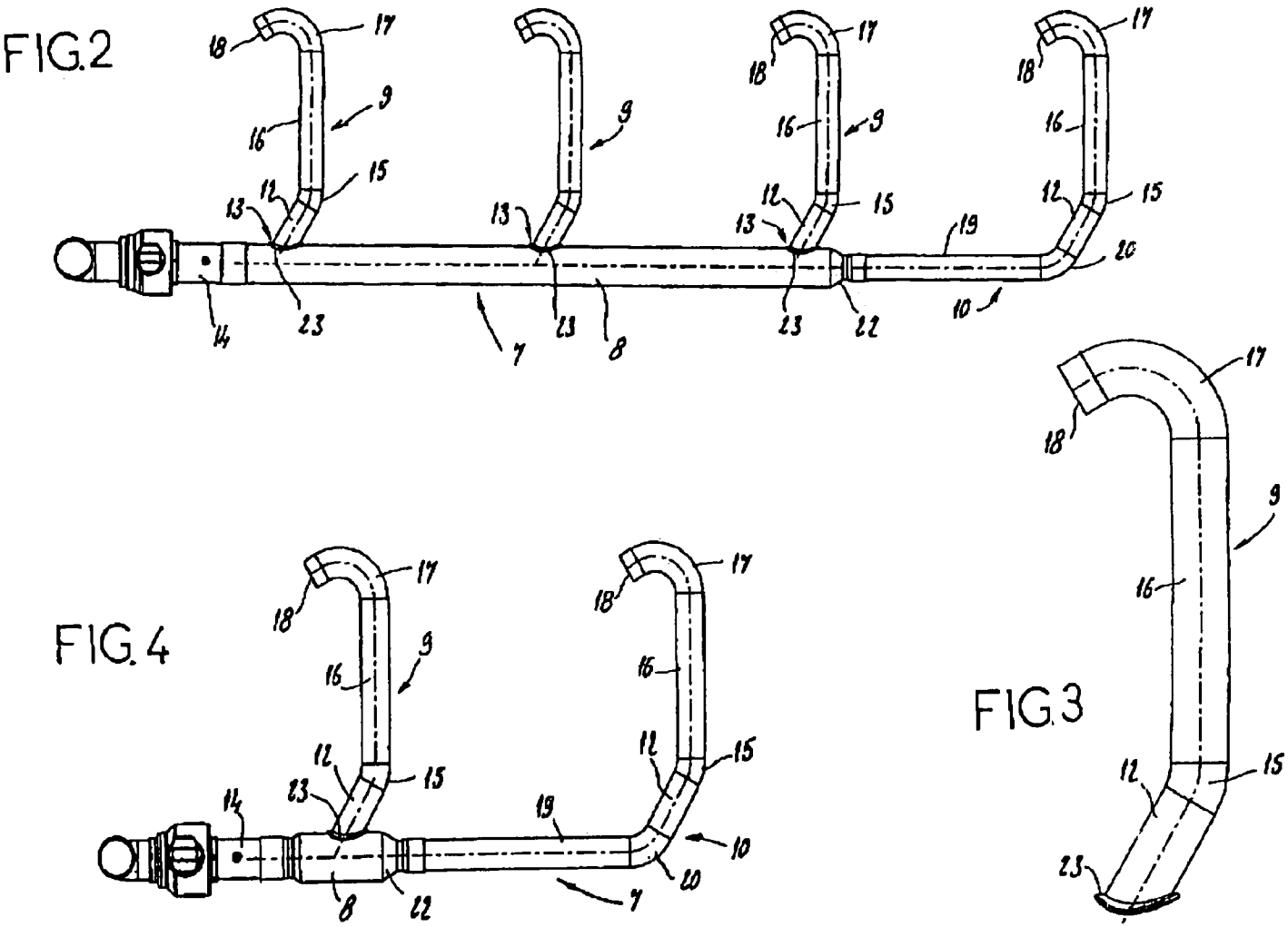
FIG. 2 is a view of the distribution device for four compressors in parallel.
FIG. 3 is a view of a branch tube showing a collar.
FIG. 4 is a view of the distribution device for two compressors in parallel.

FIG. 2 shows the distribution device 7 according to a first embodiment for an arrangement of four compressors. The distribution tube 8 has, upstream of the first branch 13, a straight portion 14 that is about 330 mm long and has five to seven times the outside diameter of the distribution tube 8. In this embodiment, the outside diameter of the branch tubes 9 is essentially equal to 1⅝ inches (one inch being equal to 2.540 cm), the outside diameter of the distribution tube 8 being essentially equal to 2⅝ inches. The distance between two branches of the distribution tube is greater than 7 times the outside diameter of the distribution tube. In the embodiment shown in FIG. 2, this distance is about 476 mm.

In the embodiment shown in FIG. 2, the distribution device has four branch tubes: three lateral branch tubes 9 and a last end branch tube 10.

The lateral branch tubes 9 are identical. They have the following adjacent portions between the distribution tube and the inlet orifice of a compressor:

- a first straight portion 12 forming an angle of about 60° with the axis of the distribution tube, 116 mm long, adjacent to the distribution tube;
- a bent portion 15 with a bending angle of about 30° and a bending radius of about 52 mm;
- a straight portion 16 forming an angle of about 90° with the axis of the distribution tube, about 229 mm long;
- a bent portion 17 with a bending angle of about 120° and a bending radius of about 52 mm; and
- a straight portion 18 forming an angle of about 210° with the axis of the distribution tube, about 19 mm long, adjacent to the compressor.

In addition to the portions previously referred to for the other branch tubes 9, the last branch tube 10 has, between the distribution tube 8 and the straight portion 12 forming an angle of about 60° with the axis of the distribution tube 8, the following adjacent portions:

- a straight portion 19 positioned in the axis of the distribution tube and communicating therewith, approximately 336 mm long; and
- a bent portion 20 with a bending angle of about 60° and a bending radius of approximately 52 mm.

The distribution tube 8 has a reduction in diameter 22 at is end communicating with the last branch tube 10. This reduction in diameter 22 reduces the outside diameter of the tube from about 2⅝ inches to about 1⅝ inches.

FIG. 3 shows a lateral branch tube 9 having a collar 23 at its end joined to the distribution tube.

FIG. 4 shows an embodiment for placing two compressors in parallel. In this embodiment, the outside diameter of the distribution tube is about 2⅛ inches. All the other measurements are the same as in the embodiment shown in FIG. 2, using only two branches: one lateral branch 9 and one end branch 10.

Other embodiments not shown enable different numbers of compressors to be placed in parallel.

While this invention has been described in conjunction with the specific embodiments outline above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. Device for distributing suction gas for a parallel compressor installation, said installation comprising:

- at least two refrigeration compressors, each having a body delimiting an inside space;
- at least one oil level equalization tube providing a communication between oil pans provided in the bodies of the compressors; and at least one suction gas distribution device including an essentially straight distribution tube as well as at least two branch tubes providing communication between the at least one distribution tube at branch portions and spaces inside the bodies of the compressors, characterized in that the at least two branch tubes have at least one portion forming an angle of between 55° and 65° with axis of the distribution tube.

2. The distribution device according to claim 1, characterized in that the at least one distribution tube has a straight portion upstream of a first branch portion, length of said straight portion being equal to at least five times outside diameter of the distribution tube.

3. The distribution device according to claim 2, characterized in that the length of the straight portion of the at least one distribution tube upstream of the first branch portion is between five and seven times the outside diameter of the distribution tube.

4. The distribution device according to claim 1, characterized in that the at least two branch tubes have a smaller outside diameter than outside diameter of the distribution tube.

5. The distribution device according to claim 1, characterized in that ratio between outside diameter of the at least two branch tubes and the outside diameter of the at least one distribution tube is between 60 and 85%.

6. The distribution device according to claim 1, characterized in that outside diameter of the at least two branch tubes is essentially equal to 1⅝ inches (1 inch being equal to 2.540 cm), the outside diameter of the at least one distribution tube being essentially equal to 2⅝ inches in the case that three or four compressors operate in parallel or being essentially equal to 2⅛ inches in the case that two compressors operate in parallel.

7. The distribution device according to claim 1, characterized in that a distance between two branches of the at least one distribution tube is at least five times outside diameter of the distribution tube.

8. The distribution device according to claim 1, characterized in that the at least two branch tubes have a bent portion downstream of the portion whose axis makes an angle of between 55° and 65° with the axis of the at least one distribution tube, said bent portion having a bending angle of between 115 and 120° and a bending ratio essentially equal to 1.25 times an outside diameter of the at least two branch tubes.

9. The distribution device according to claim 1, characterized in that the portion of the at least two branch tubes forming an angle of between 55° and 65° with the axis of the at least one distribution tube is adjacent to the at least one distribution tube on at least one of the at least two branch tubes.

10. The distribution device according to claim 1, characterized in that a last branch tube has a straight portion positioned in the axis of the distribution tube and communicating therewith, upstream of the straight portion whose axis forms an angle of between 55° and 65° with the axis of the at least one distribution tube.

11. The distribution device according to claim 10, characterized in that the straight portion of the last branch tube positioned in the axis of the at least one distribution tube and communicating therewith has a length equal to at least five times the outside diameter of the at least one distribution tube.

12. The distribution device according to claim 1, characterized in that at least one of the branch tubes has a collar at its end joined to the at least one distribution tube.

* * * * *